US011014119B2

(12) United States Patent
Sung

(10) Patent No.: US 11,014,119 B2
(45) Date of Patent: May 25, 2021

(54) DISPENSING LID AND CONTAINER

(71) Applicant: Kiss Nail Products, Inc., Port Washington, NY (US)

(72) Inventor: Siyong Sung, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 16/289,258

(22) Filed: Feb. 28, 2019

(65) Prior Publication Data

US 2020/0276609 A1 Sep. 3, 2020

(51) Int. Cl.
*B05C 5/02* (2006.01)
*A45D 34/04* (2006.01)

(52) U.S. Cl.
CPC ..... *B05C 5/0254* (2013.01); *A45D 34/045* (2013.01)

(58) Field of Classification Search
CPC ..... B05C 5/0254; A45D 34/045; A45D 34/04
USPC ..... 222/420, 92, 106, 107, 206, 215, 222/566–569; 401/11, 183, 184, 261, 401/262, 265, 266; 132/74.5, 73, 73.5
See application file for complete search history.

(56) References Cited

U.S. PATENT DOCUMENTS 817,890 A * 4/1906 Williams ..... B65D 83/258 401/139
1,715,914 A * 6/1929 Halk ..... A45D 40/28 132/73
2,279,520 A * 4/1942 Perillo ..... A45D 34/042 132/74.5
2,442,503 A * 6/1948 Melnikoff ..... A45D 40/04 132/320
2,550,890 A * 5/1951 Vaughn ..... A45D 29/16 132/74.5
2,716,251 A * 8/1955 Pearce ..... A23G 3/2023 401/139
2,772,432 A * 12/1956 Andreola ..... B65D 47/265 401/263
2,876,782 A * 3/1959 Hudgens ..... A45D 29/16 132/74.5
4,440,181 A 4/1984 Scherer
4,946,081 A * 8/1990 Jacobson ..... B05C 17/00516 222/568
5,277,511 A * 1/1994 Stockton ..... B05C 17/00503 118/255
5,415,488 A * 5/1995 MacGibbon ..... B65D 83/285 401/139
5,678,729 A 10/1997 Raymond
5,695,788 A 12/1997 Woods
D396,131 S * 7/1998 Wiggins ..... D28/57
5,797,407 A 8/1998 Davis et al.
5,879,095 A * 3/1999 Gueret ..... A45D 34/042 401/172
6,035,859 A * 3/2000 Antonopoulos-McIvor ..... A45D 29/007 132/320

(Continued)

*Primary Examiner* — Lien M Ngo
(74) *Attorney, Agent, or Firm* — Cherskov Flaynik & Gurda, LLC

(57) ABSTRACT

A dispensing lid is provided comprising: a proximal end that is adapted to be attached to a container; a distal end; and a cavity extending from the proximal end to the distal end, wherein a release port and a plate-like tap are provided at the distal end; and the release port is communicated with the cavity and comprises an opening.

20 Claims, 4 Drawing Sheets

(56) References Cited

U.S. PATENT DOCUMENTS 6,196,746 B1 * 3/2001 Onischuk ..... A47G 27/0487 401/261
8,662,780 B2 * 3/2014 Fontana ..... A45D 34/04 401/132
8,777,506 B2 * 7/2014 Akaishi ..... A45D 34/04 401/172
8,845,223 B2 * 9/2014 Liao ..... B05C 17/00516 222/566
10,306,969 B1 * 6/2019 Laaly ..... A45D 34/042
10,702,038 B2 * 7/2020 Mitchell ..... B08B 1/001
2002/0148479 A1 * 10/2002 Willis ..... A45D 29/17 132/75.3
2003/0057236 A1 * 3/2003 Delage ..... A45D 40/26 222/390
2005/0047848 A1 * 3/2005 Carraher ..... A45D 40/02 401/266
2005/0217685 A1 * 10/2005 Burkholz ..... A45D 29/17 132/74.5
2006/0065677 A1 * 3/2006 Py ..... A45D 34/04 222/383.1
2006/0273200 A1 12/2006 Williams et al.
2008/0041404 A1 2/2008 Vo
2009/0045230 A1 2/2009 Liberatore
2010/0260532 A1 10/2010 Tsai
2010/0278958 A1 * 11/2010 Chamberlain .... B05C 17/00516 425/458
2014/0234003 A1 * 8/2014 Thorpe ..... A45D 29/16 401/1
2014/0376985 A1 * 12/2014 Villarreal ..... A45D 34/04 401/2
2016/0143415 A1 * 5/2016 Laaly ..... A45D 34/042 401/193
2016/0167081 A1 6/2016 Kim
2018/0029069 A1 2/2018 Wolf et al.

* cited by examiner

DISPENSING LID AND CONTAINER

BACKGROUND OF THE INVENTION

1. Field of the Invention

The field of the invention is a container and a lid for dispensing fluid.

2. Background of the Invention

Artificial nails made from thin, molded plastic members have been popular for ornamental use. Typically, to apply the artificial nail, a thin layer of glue is distributed so as to attach the artificial nail to the natural finger nail. When the artificial nail is to be removed from the finger nail, a liquid glue remover is used. The liquid glue remover is dispensed from its container to the periphery of the artificial nail to resolve or soften the glue, and then a stick having a thin tip is used as a lever to lift and separate the artificial nail from the natural nail. The stick can made of materials such as wood, plastics, glass, or metal. Since the user has to operate with just one hand to remove the artificial nail, it will take a few steps to do so. In addition, such a stick is normally elongated and small and thus can easily get lost. Further, the sticks can break. A user may need to prepare a large amount of such sticks, which causes a waste.

A need exists in the art for a means that can simplify the removal of the artificial nails. A need also exists for a means which minimizes waste and delivers the liquid remover to its intended site using a single container and dispenser that provides a simpler glue removal system.

SUMMARY OF INVENTION

An object of the invention is to create a device for storing and dispensing fluid such as glue remover for artificial nails, that overcomes many of the drawbacks in the prior art. A feature of the invention is that one end of the container is provided with a dispenser and tip. An advantage of the invention is that the dispenser can be used to apply the glue remover to the artificial nails and also act as a lever to separate the artificial nail from the natural nail.

A further object of the invention is to provide for a system that allows for dispensing of varying amounts of glue remover. A feature of the invention, in one embodiment, is that the container comprises reversibly deformable material. An advantage of the invention is that the amount of glue extruded through the dispenser is controlled by the amount of squeezing action undertaken by the end user of the container.

Another object of the invention is to simplify the operation of dispensing the fluid to desired sites. A feature of the invention is that the dispenser is integrated with the peripheral wall of the release port of the container and extends beyond the release port in the longitudinal direction of the container. An advantage of the invention is that the end user can easily direct the fluid released to the tip with just one hand and the flow of the glue can be controlled with a high degree of precision, in one embodiment.

Another object of the invention is to facilitate the distribution of the fluid from the release port to the tip. A feature of the invention is that a groove is provided in a surface of the tip and leads to the opening of the release port. An advantage of the invention is that the groove facilitates the distribution of the fluid from the opening of the release port to the tip.

Yet another object of the invention is to provide a device that can easily separate the artificial nail from the natural nail to which it is attached. A feature of one embodiment is that the tip extends along the width direction and may be curved like a natural nail. An advantage of one embodiment is that it can be increase the contact area with the nails when the tip is used as a lever to separate the artificial nail from the natural nail. Another feature of another embodiment is that the tip has a relative small width. An advantage of another embodiment is that a smaller tip can be easily inserted into small gaps between the artificial nail and natural nail.

Another object of the invention is to provide an artificial nail remover which uses a single piece. A feature of the system is that both the lever action and the glue dispensing action is performed by the tip of the container of the glue removing solution. A benefit of the invention, in one embodiment is that it does not require the use of an external nail lifting stick.

A further object of the invention is to provide a system of dispensing glue remover which is hygienic and easy to clean. A feature of the system is that the tip of the container is removable, in one embodiment, and can be cleaned separately. A benefit of the invention, is that the end user of the dispenser can clean the dispenser tip without diluting the glue remover solution located in the container.

A dispensing lid is disclosed comprising: a proximal end that is adapted to be attached to a container; a distal end; and a cavity extending from the proximal end to the distal end, wherein a release port and a tip are provided at the distal end; and the release port is communicated with the cavity and comprises an opening. A container is disclosed comprising a main body and the dispensing lid that is attached to the main body.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

In various embodiments, the invention provides a container for dispensing of a liquid and a lid adapted to be used with the container. The liquid may be an adhesive, an adhesive thinner, a glue remover, acetone, combinations thereof, or other additive.

In one embodiment, the invention comprises a dispensing lid that is adapted to be attached to a container, comprising: a proximal end that is adapted to be attached to the container; a distal end; and a cavity extending from the proximal end to the distal end, wherein a release port and a tip are provided at the distal end; and the release port is communicated with the cavity and comprises an opening.

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 2:
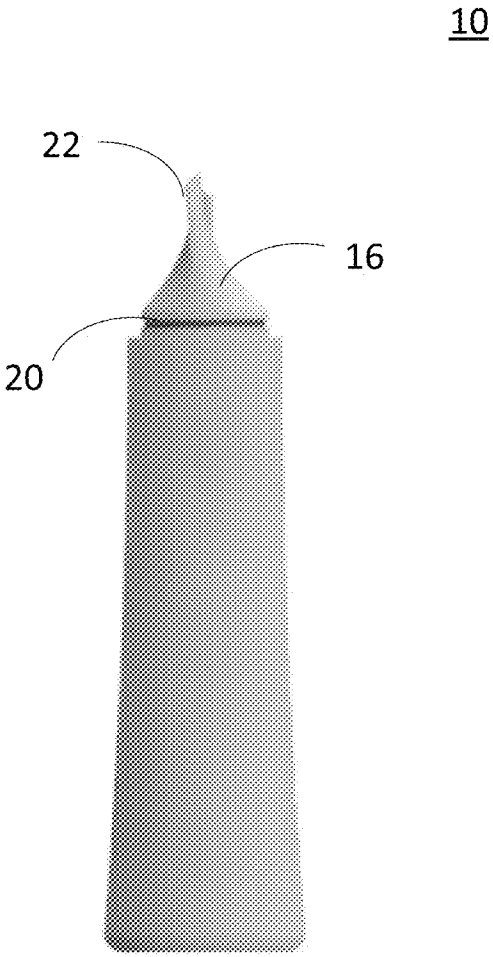
FIG. 2 depicts a side view of one embodiment of the invention.
Figure 1:
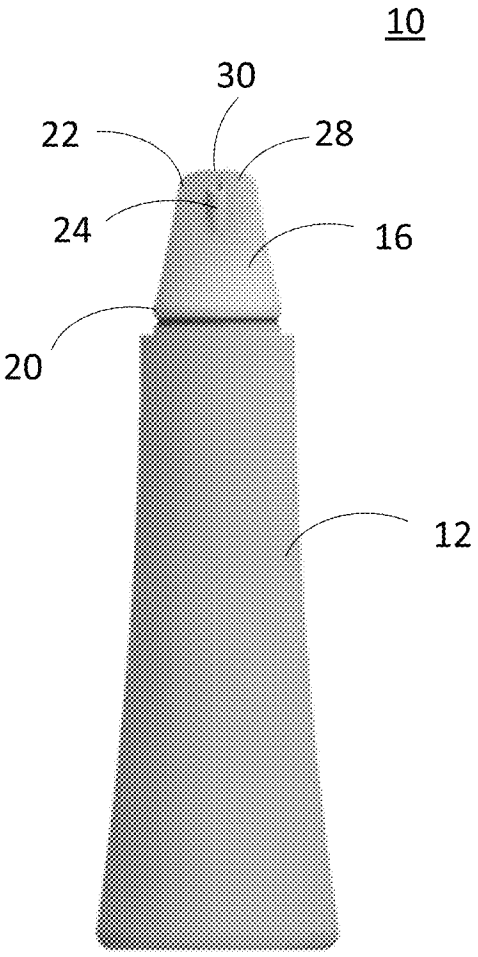
FIG. 1 depicts a front view of one embodiment of the invention.
Figure 5:
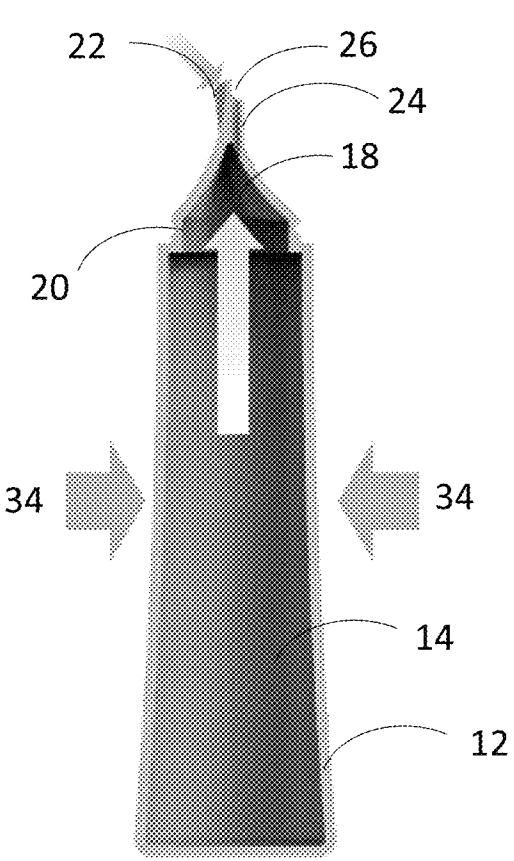
FIG. 5 depicts a cross sectional view of one embodiment of the invention taken along the line 5-5 in FIG. 3.
Figure 3:
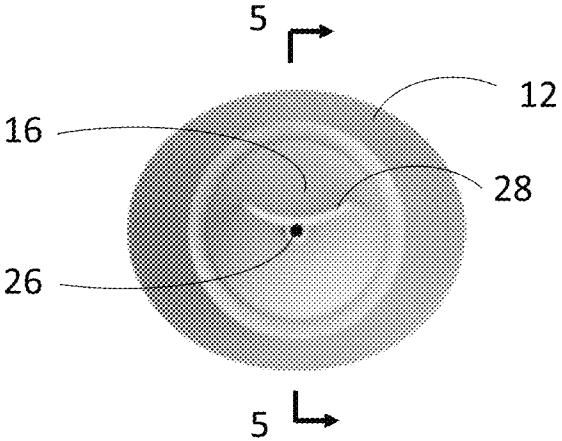
FIG. 3 depicts a top view of one embodiment of the invention.
Figure 4:
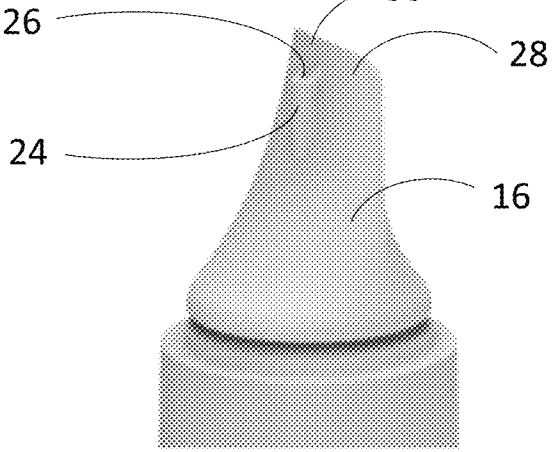
FIG. 4 depicts a perspective view of a part of one embodiment of the invention.

Turning to the figures, FIG. 1 depicts a front view of one embodiment of the invention. FIG. 2 depicts a side view of one embodiment of the invention. FIG. 3 depicts a top view of one embodiment of the invention. FIG. 4 depicts a partial perspective view of one embodiment of the invention. FIG. 5 depict a sectional view of one embodiment of the invention taken along line 5-5 of FIG. 3.

The container 10 is defined by a main body 12. As shown in FIG. 1, the main body 12 comprises a generally frustum shape. However, in other embodiments, the main body 12 comprises a cylindrical shape, a column shape, and other shapes, depending on the required application. In one embodiment the shape of the main body includes gripping features to allow for easier holding of the container by its end user (not shown)

As shown in the cut-away view of one embodiment of FIG. 5, the main body 12 is substantially hollow with a main cavity 14. In one embodiment, the main body 12 is made of a flexible material such as a deformable plastic, rubber, and resin. In one embodiment, the main body comprises Polypropylene (PP) or high-density polyethylene (HDPE). The material is selected so as to not react with the fluid to be contained in the main body 12. In one embodiment, the fluid comprises acetone as the active ingredient. In many embodiments, the body 12 can be squeezed by varying amounts to facilitate the dispensing of the liquid in the container. However, in another embodiment, the body 12 can be made of other materials such as hardened plastics, glass, wood, and metal. In this case, the liquid can be dispensed through gravity, or means such as a bladder or a pump that is activated by the end user (not shown).

While the main body is shown as having an opaque appearance in FIGS. 1-9, in other embodiments the main body comprises a transparent material. In other embodiments, the main body comprises a translucent material. In these embodiments, the end user can hold up the bottle next to a light source and determine the amount of liquid remaining to be dispensed in the container 10. In yet another embodiment, the main body includes a transparent stripe (not shown) extending the longitudinal axis of the container 10. The transparent stripe allows the end user to reference the amount of fluid left remaining in the container.

As shown in FIG. 1, the container 10 further comprises a dispenser embedded in a lid 16. The lid 16 comprises a proximal end 20, a distal end 22. As shown in FIG. 5, in the cut away view, the lid 16 also comprises a cavity 18 extending from the proximal end 20 to the distal end 22. The proximal end 20 is attached to the main body 12 so that the cavity 18 is in fluid communication with the main cavity 14 of the main body 12. In one embodiment, the proximal end 20 is attached to the main body 12 through a threaded fitting. In another embodiment, the proximal end 20 can be attached to the main body 12 through snap fitting, welding, or molding, among the others. In another embodiment, the lid 16 and the main body 12 are integrally molded as a single piece.

In one embodiment, the main body 12 comprises a reversibly deformable material, such as a plastic having a resin combined with a base such as Polypropylene (PP) or high-density polyethylene (HDPE) as discussed above. The lid 16 comprises a more rigid plastic material, such as a more rigid polypropylene mix. In one embodiment, the lid 16 is made of a material that is sufficiently rigid to be used as a lever. For example, in some embodiments, the tip comprises or incorporates wood, metal, and plastics such as polyethylene (PE), polypropylene (PP), polystyrene (PS), polyvinyl chloride (PVC), and acrylic plastics, combinations thereof, among the others. In one embodiment, all of components of the lid 16 is made of the same material. In other embodiments, the sub-components of the lid (described below) use different materials depending on their intended purpose. Further, in some embodiments, certain elements of the lid are reinforced, such as by including metal or wood filaments. In this way, the lid 16 can act as a lever, while the main body 12 can be squeezed by the end user of the dispenser.

Dispenser Lid Details

The dispenser lid 16 is provided with a release port 24 for dispensing and releasing a fluid that is contained in the container 10. As shown by FIG. 5, the release port 24 is cylindrical and communicated with the cavity 18. The release port 24 comprises an opening 26 from which the fluid can be released and dispensed. The cross-section of the opening 26 is round, in one embodiment. In another embodiment, the cross-section of the opening can be oval, rectangular, and slit, among other shapes.

The dispensing lid 16 is further provided with an elongated lever member 28. As shown in FIGS. 1 and 4, the elongated member 28 is integrated with the release port 24 and extends beyond the release port 24 in the longitudinal direction from the proximal end to the distal end. Therefore, the member 28 forms a protruding tip of the lid 16.

In one embodiment, the member 28 also extends in the width direction that is perpendicular to the longitudinal direction. The member 28 includes a tapered shape towards its tip end. In one embodiment, the width of the tip end of the elongated member 28 is between 6 mm and 15 mm.

In one embodiment, a groove 30 is provided in the surface of the dispenser lid 16, which leads to the opening 26 of the release port 24. The groove 30 functions to direct the fluid that is released from the opening 26 towards the tip of the dispenser lid 16. The groove 30, in this embodiment, functions as a channel to direct fluid.

The elongated member 28 can be used as a lever. In one embodiment, an end-user can use the dispensing lid 16 as a lever to separate an artificial nail from a natural nail to which the artificial nail is attached. In this embodiment, the member 28 is curved and, preferably, includes a curvature analogous to a natural nail. In this case, when a user insert the tip of the lid 16 between the artificial nail and the natural nail, a line contact is formed between the tip and the natural nail, which increase the contact area between the tip and natural nail and thus facilitate the separation of the artificial nail from the natural nail without requiring a large force exerted by the user. In this case, the release port 24 and thus its opening 26 are preferably provided on the convex side of the elongated member 28. Therefore, when the container 12 is used to separate an artificial nail from a natural nail, the release port 24 will be on the upper side of the tip 16 and thus will leave no obstruction between the lid 16 and the user's fingers or nails.

During the dispensing action, the user will also be able to see the opening 26 of the release port 24 clearly, so as to make it easier to control the amount of the fluid, such as a glue remover, released from the opening 26.

In one embodiment, the elongated member 28 is made so that its thickness is tapered towards the tip end. In this case, the tip end of the member 28 is thin enough to be inserted into the gap between the artificial nail and the natural nail while the overall strength of the lid 16 is maintained.

In at least one embodiment of the invention, the dispensing lid 16 is removably attached to the container 10. In such embodiments, the dispensing lid 16 can be cleaned after use such as by submerging in water without diluting the liquid found within the container 10. In this way, the release port 24 does not clog or otherwise become dirty leading to the container 10 being discarded even if it still holds fluid.

Container Operation

Turning to the details of the operation of the container 10, the container 10 is used during the process of removing an artificial nail from a natural nail to which the artificial nail is attached via a glue or adhesive.

Referring to FIG. 5, after inserting the dispensing member 28 under the artificial nail, an end-user squeezes the main body 12 of the container 10, as shown by the arrows 34, normally when pointing the tip 28 downwardly at the artificial nail to be removed. Some of the glue remover, in one embodiment, a few droplets, is forced to be released from the opening 26 of the dispensing port 24. The glue remover will then flow to the tip end of the tip 28, directed with the groove 30. The user may move the tip along the interface between the artificial nail and the natural nail so as to apply the glue remover at the desired positions. When the glue is partly dissolved or softened by the glue remover, the nail can be lifted higher. Thus, the dispenser tip is pushed further to create a gap between the artificial nail and the natural nail, the user may then insert the tip in the gap and separate the artificial nail from the natural nail by using the tip as a lever.

These steps can be done with just one hand thus greatly simplifies the operation.

Alternative Embodiment

Figure 7:
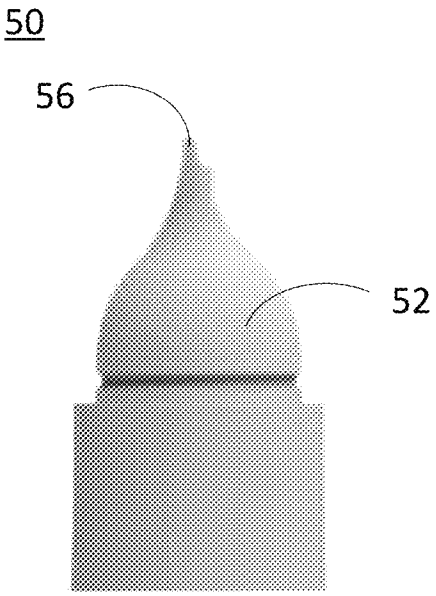
FIG. 7 depicts a side view of a part of another embodiment of the invention.
Figure 6:
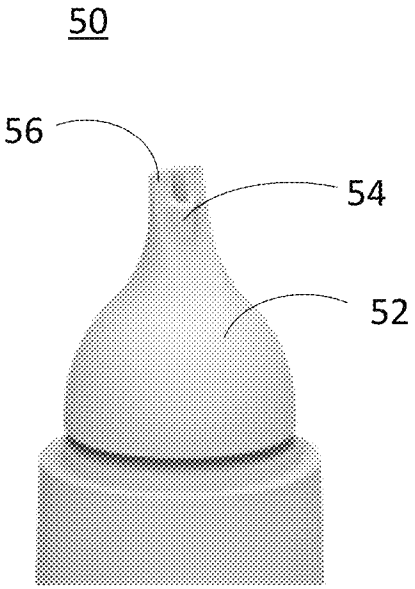
FIG. 6 depicts a perspective view of a part of another embodiment of the invention.

A further embodiment is shown in FIGS. 6 and 7 that depict a part of the container. In that embodiment, the container 50 is similar to the container 10 except for a different configuration of the tip 56 of the lid 52. The lid 52 is also provided with a release port 54 and a tip 56. In this embodiment, the tip 56 is also formed integrated with the wall of the release port 54. The tip 56 extends from a part of the wall of the release port 54 and beyond the release port 54 in the longitudinal direction.

In this embodiment, the width of the tip end of the tip 56 is relatively small. The tip end width of the tip 56 can be between 2 mm and 8 mm. Therefore, the tip end of the tip 56 thus can be inserted into smaller gaps.

The alternative embodiment 50 is suitable for end users having smaller natural nails. Further, it can be useful when the glue remover only creates small gaps between the artificial nail and the natural nail. In this case the contact area between the tip and the artificial nail or natural nail is relatively small and thus may require relatively large force to separate the artificial nail from the natural nail.

Manufacturing Details

A method for manufacturing the container, such as the embodiments 10 or 50 preferably occurs through injection molding. A plastic, such as PET, is heated and placed in a mold, where it assumes the shape of a tube. The tube is then transferred into a second mold with its interior topology conforming to the desired shape of the container main body. The tube is filled with highly pressurized air and stretched into the mold, assuming the desired shape of the body.

A similar injection molding process is used for the dispensing lid, in one embodiment. The lid can be formed similarly followed by machining process to finish the opening and remove excess plastic. In embodiments where the lid is not integrally molded to main body, the lid comprises attachment features and is attached to the container main body through snap fitting, welding, or molding, among the others.

Depending on required applications and the intended materials, the main body or the lid can also be manufactured through molding, machining, numeric controlled machining, 3D printing, among the others.

Additional Alternative Embodiments

Figure 8:
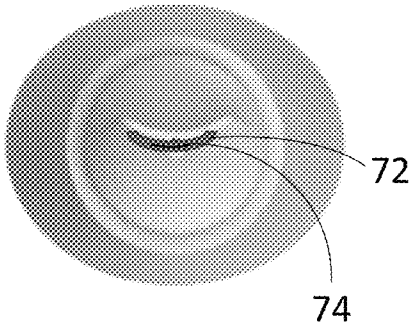
FIG. 8 depicts a top view of an alternative embodiment of the invention.

In a further alternative embodiment shown in FIG. 8, the release port 72 is not cylindrical but extends along the width of the member like an elongated oval. In this case, the opening 74 is defined as a slit instead of a round hole. Thus, the fluid can be distributed more evenly along the width of the member. However, larger quantities of the fluid are dispensed as the opening 74 has a larger capacity than the round opening of previous embodiments.

Figure 9:
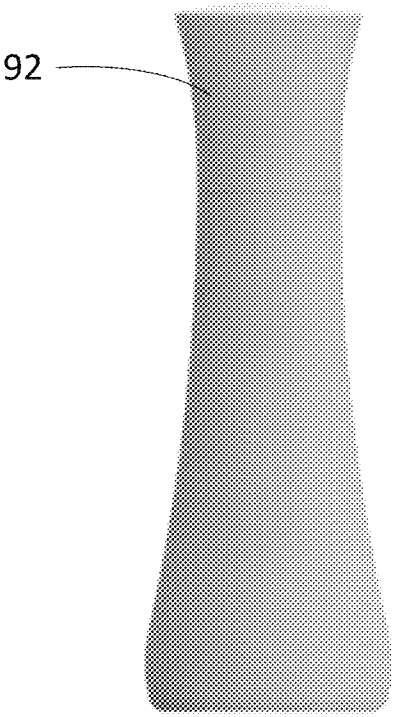
FIG. 9 depicts a side view of yet another embodiment of the invention.

In yet another embodiment as shown in FIG. 9, the container further comprises a cap 92 that is reversibly attached to the container main body so as to cover the dispensing portion.

In still another embodiment (not shown), the release port may include a plurality of openings that are communicated with the cavity of the lid. This arrangement may also help distribute the fluid more evenly.

In a further anther embodiment (also not shown), a press pump may be provided in the lid to communicate the cavity of the main body with the releasing port. Therefore, a press down on the pump top will bring fluid from the container main body to the release port.

In still further another embodiment (not shown), the tip may protrude in another direction then the longitudinal direction, even in a direction that is perpendicular to the longitudinal direction. In addition, the tip may be formed with a distance to the release port instead of integral with the release port.

The cut away view of FIG. 5 shows the cavity 14 of the main body 12 as substantially empty and having a flat bottom end opposite of the proximal end 20 of the dispensing lid. In another embodiment, not shown, the bottom of the main body 12 is substantially curved. This allows for stacking of multiple dispensers on top of each other, so that the dispensing lid 16 of one can be removably received by the bottom portion of the next and the bottles can be kept in place during shipping or can be dispensed one at a time from a box having multiple layers of the filled items.

Also, as shown in FIG. 5, the main cavity 14 is shown as not having any dividers. In one embodiment, the main cavity 14 includes a wall that allows for the storage of more than one liquid. The liquids are then combined when the end user squeezes the bottle and the liquids exit the bottle through the opening 26.

Further, while the dispensing lid includes a substantially empty cavity 18 in FIG. 5, in another embodiment the cavity 18 includes a sponge through which the liquid contained by the main cavity 14 will first saturate before exiting the opening 26. In this embodiment, the flow rate is designed to be more uniform. Further this embodiment allows for mixing of various liquids from the main cavity 14 before exiting the opening 26.

In another embodiment, the main cavity 14 also includes a mixing element, such as a metallic ball, not shown, that allows for mixing of the fluid contained in the main body 12.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The embodiment of the invention in which an exclusive property or privilege is claimed is defined as follows:

1. A dispensing lid comprising:

a proximal end that is adapted to be attached to an open container holding a fluid to be dispensed;

a distal end;

a cavity extending from the proximal end to the distal end; wherein a release port and an elongated lifting member are provided at the distal end;

the release port is in liquid communication with the cavity and comprises an opening; and wherein the elongated lifting member includes a lever area which is sufficiently rigid to be adapted to lift an artificial fingernail and the elongated lifting member forms an elongated surface of the distal end, and terminates in a tip that is tapered in thickness and wherein said tip tapered thickness lifts the artificial fingernail when the tip is inserted under an artificial fingernail;

wherein a fluid direction channel is provided in a surface of the member and leads to the opening of the release port;

wherein the member extends in a width direction that is perpendicular to a longitudinal direction;

wherein said member is curved along its width;

wherein the release port is arranged at a convex side of the member.

2. The dispensing lid of claim 1 wherein a width of the member is tapered with thinner profiles extending towards a tip of the member.

3. The dispensing lid of claim 1, wherein the opening comprises a plurality of openings.

4. A container comprising:

a main container body comprising a main cavity; and a dispensing lid comprising:

a proximal end that is attached to the container body;

a distal end;

a cavity extending from the proximal end to the distal end and is communicated with the main cavity, wherein a release port and an elongated member are provided at the distal end;

the release port comprises an opening that is in fluid communication with the cavity; and the member forms an elongated surface of the distal end, and terminates in a tapered tip in thickness and wherein the member includes a lever area which is sufficiently rigid to be adapted to lift an artificial fingernail and wherein said tip tapered thickness lifts the artificial fingernail when the tip is inserted under the artificial fingernail;

wherein the member is integrated with the release port and extends beyond the release port in a longitudinal direction from the proximal end to the distal end;

wherein said member is curved along a width direction that is perpendicular to the longitudinal direction;

wherein the release port is arranged at a convex side of the member.

5. The container of claim 4 wherein said container body comprises a compressible material.

6. The container of claim 4 further comprising a closure that is reversibly attached to the container body so as to cover the distal end.

7. The container of claim 4 wherein a fluid directing channel is provided in a surface of the member and leads to the opening of the release port.

8. The container of claim 4 wherein a width of the member is tapered towards the tip.

9. The container of claim 4, wherein the opening comprises a plurality of openings.

10. The dispensing lid of claim 1 wherein the elongated lifting member is curved like a natural nail.

11. The dispensing lid of claim 1 wherein the elongated lifting member comprises polypropylene.

12. The dispensing lid of claim 4 wherein the elongated member comprises polypropylene.

13. The dispensing lid of claim 1 wherein said member is integrated with the release port.

14. The container of claim 4 wherein said member is integrated with the release port.

15. The dispensing lid of claim 1 wherein said release port has a round cross-section.

16. The container of claim 4 wherein said release port has a round cross-section.

17. The dispensing lid of claim 1 wherein said release port has a non-circular cross-section.

18. The container of claim 4 wherein said release port has a non-circular cross-section.

19. The dispensing lid of claim 1 wherein said lid is adapted to be removable when installed on the container.

20. The container of claim 4 wherein said dispensing lid is removable.

* * * * *